US007597584B2

(12) United States Patent
Yamaji

(10) Patent No.: US 7,597,584 B2
(45) Date of Patent: Oct. 6, 2009

(54) CONNECTOR AND ELECTRONIC APPARATUS INCLUDING THE SAME

(75) Inventor: Takahiro Yamaji, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/218,494

(22) Filed: Jul. 15, 2008

(65) Prior Publication Data

US 2009/0029601 A1 Jan. 29, 2009

(30) Foreign Application Priority Data

Jul. 26, 2007 (JP) ..... 2007-195025

(51) Int. Cl.
*H01R 12/24* (2006.01)

(52) U.S. Cl. ..... 439/495; 439/660; 439/680; 439/694

(58) Field of Classification Search ..... 439/495, 439/497, 579, 607, 660, 680, 694
See application file for complete search history.

(56) References Cited

U.S. PATENT DOCUMENTS

| | | | | |
|---|---|---|---|---|
| 6,527,592 | B2 * | 3/2003 | Mochizuki et al. | 439/660 |
| 6,565,389 | B1 | 5/2003 | Igarashi | |
| 6,821,158 | B2 * | 11/2004 | Iida et al. | 439/660 |
| 7,273,381 | B2 * | 9/2007 | Ito | 439/79 |
| 7,281,943 | B1 * | 10/2007 | Yamaji | 439/495 |
| 7,354,300 | B2 | 4/2008 | Shindo | |
| 7,377,803 | B2 | 5/2008 | Matsuoka | |
| 7,425,158 | B2 * | 9/2008 | Ookura | 439/660 |
| 2003/0176111 | A1 * | 9/2003 | Iida et al. | 439/660 |
| 2007/0066136 | A1 | 3/2007 | Kim | |
| 2008/0014789 | A1 | 1/2008 | Matsuoka et al. | |
| 2009/0011623 | A1 * | 1/2009 | Hisamatsu et al. | 439/79 |
| 2009/0029598 | A1 * | 1/2009 | Yamaji et al. | 439/660 |
| 2009/0029601 | A1 * | 1/2009 | Yamaji | 439/694 |

FOREIGN PATENT DOCUMENTS

| | | |
|---|---|---|
| EP | 1 320 149 | 6/2003 |
| EP | 1 337 009 | 8/2003 |
| JP | 2003-007401 | 1/2003 |
| JP | 2005-129255 | 5/2005 |
| JP | 2005-322470 | 11/2005 |
| JP | 3-119722 | 2/2006 |
| JP | 2006-049211 | 2/2006 |
| JP | 2006-107991 | 4/2006 |

(Continued)

OTHER PUBLICATIONS

European Search Report dated Nov. 7, 2008.

(Continued)

*Primary Examiner*—James Harvey
(74) *Attorney, Agent, or Firm*—Collard & Roe, P.C.

(57) ABSTRACT

A connector comprises an insulator, a plurality of contacts, and a mold-in shell. The plurality of contacts and the mold-in shell are integrally formed with the insulator. The mold-in shell has a first body, a second body, and coupling portions. The coupling portions couples the first body and the second body so that the first body and the second body differ in positions in a Z-direction.

11 Claims, 9 Drawing Sheets

FOREIGN PATENT DOCUMENTS

| | | |
|---|---|---|
| JP | 2006-147473 | 6/2006 |
| JP | 2006-164572 | 6/2006 |
| JP | 2006-344524 | 12/2006 |
| JP | 2007-087910 | 4/2007 |
| WO | WO 94/26004 | 11/1994 |
| WO | WO 2005/043687 | 5/2005 |
| WO | WO 2005/101581 | 10/2005 |
| WO | WO 2007/110699 | 10/2007 |

OTHER PUBLICATIONS

Provisional opinion of the Examiner, Nov. 7, 2008

Japanese Office Action dated May 7,2009 with English translation of same.

* cited by examiner

CONNECTOR AND ELECTRONIC APPARATUS INCLUDING THE SAME

CROSS REFERENCE TO RELATED APPLICATIONS

Applicants claim priority under 35 U.S.C. §119 of Japanese Application No. 2007-195025 filed Jul. 26, 2007.

BACKGROUND OF THE INVENTION

This invention relates to a connector connected to a plurality of cables and an electronic apparatus including the connector.

There have been proposed various kinds of connectors for connecting a plurality of small gauge coaxial cables to a circuit board or for connecting flat cables to a board. These types of connectors are disclosed in, for example, JP-A 2003-7401 and JP-A 2006-147473, each of which is incorporated herein by reference in its entirety.

According to JP-A 2003-7401 or JP-A 2006-147473, a connector comprises an insulator, a plurality of contacts held by the insulator, and a shell. The shell is attached to the insulator after a plurality of cables has been connected to the insulator.

This type of structure is required to have a certain level of strength, otherwise the connector, especially the thin-type connector, may be broken when attaching the cables to the insulator.

SUMMARY OF THE INVENTION

It is an object of the present invention to provide a connector which takes on a certain level of strength and which can be made thin.

In accordance with one aspect of the present invention, there is provided a connector connectable to a plurality of cables comprising: a plurality of contacts each having a cable connect portion to be connected to one of the cables; an insulator holding the plurality of contacts; and a mold-in shell formed through a mold-in process according to which the mold-in shell is positioned in part within the insulator when the insulator is molded. The mold-in shell has a first body, a second body and two coupling portions. Each of the first and the second bodies has a long side and a short side. The long side extends in the first direction while the short side extends in a second direction perpendicular to the first direction. The coupling portions couples the first body with the second body so that the first body and the second body differ in position in a third direction perpendicular to the first and the second directions.

In accordance with another aspect of the present invention, there is provided an electronic apparatus comprising the connector and a mating connector to be connected to the connector.

An appreciation of the objectives of the present invention and a more complete understanding of its structure may be had by studying the following description of the preferred embodiment and by referring to the accompanying drawings.

Figure 1:
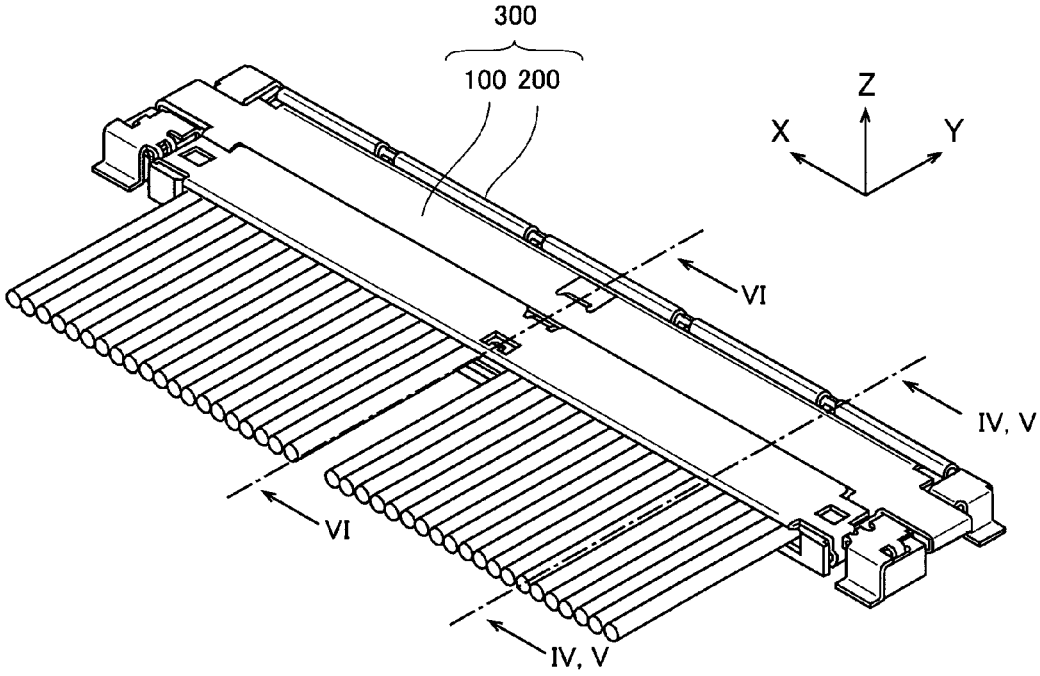
FIG. 1 is a perspective view of a connector assembly according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF THE PREFERRED EMBODIMENT

With reference to FIGS. 1 to 3 and 10, a connector assembly 300 according to an embodiment of the present invention comprises a connector 100 and a mating connector 200. The connector 100 is connected to a plurality of cables 400. The cables 400 are held by a ground bar 500. The connector 100 connected to the cables 400 is fittable with the mating connector 200 to be mounted on a board. The connector assembly 300 is generally used in an electronic device such as a cellular phone.

Figure 2:
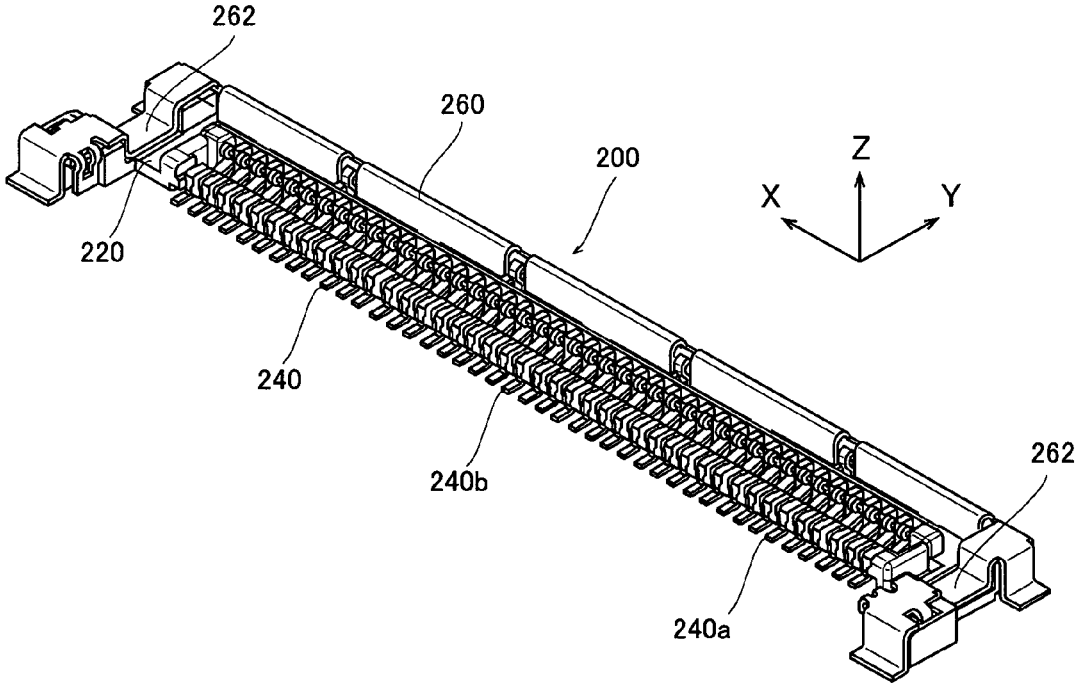
FIG. 2 is a perspective view showing a mating connector constituting the connector assembly of FIG. 1.
Figure 5:
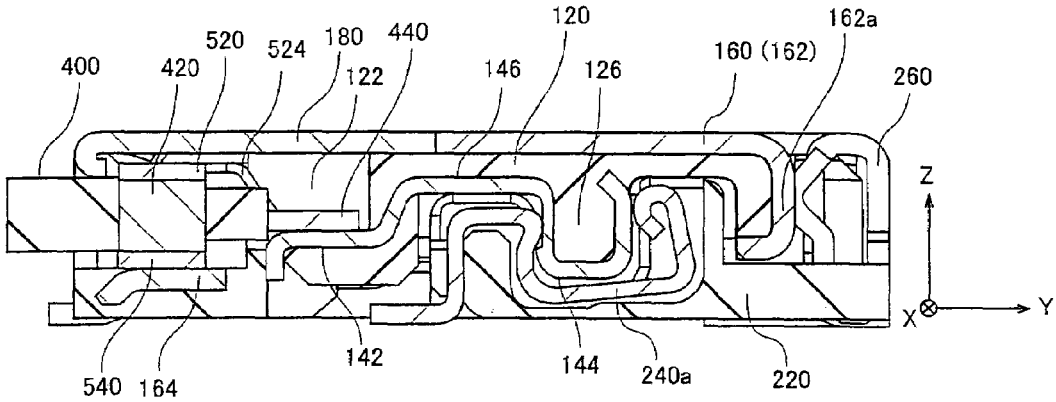
FIG. 5 is a cross-sectional view showing the connector assembly taken along lines V-V in FIG. 1.
Figure 6:
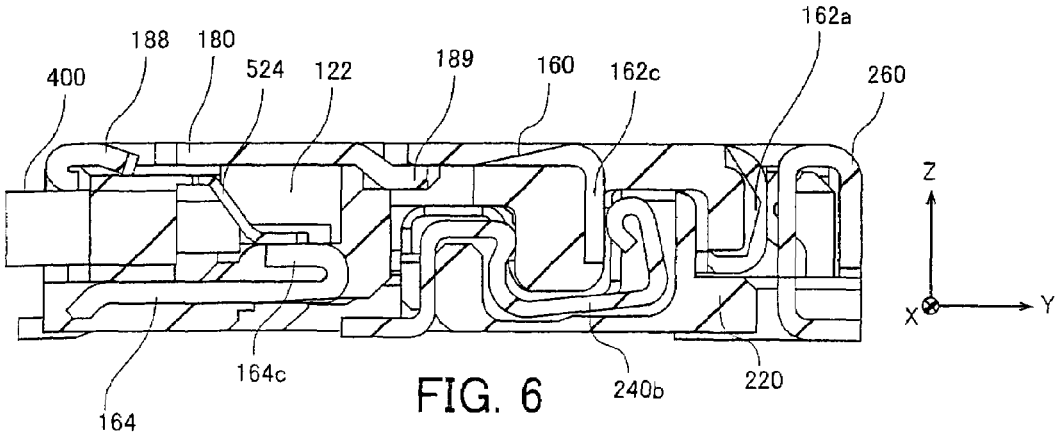
FIG. 6 is a cross-sectional view showing the connector assembly, taken along lines VI-VI in FIG. 1.

With reference to FIGS. 2, 5, and 6, the mating connector 200 of this embodiment extends in an X-direction and comprises an insulator 220, a plurality of contacts 240 held by the insulator 220, and a shell 260 covering a part of the insulator 220. The contacts 240 include signal contacts 240*a* and ground contacts 240*b*. The mating connector 200 has two receiver portions 262 each formed at an end of the mating connector 200 in the X-direction.

Figure 10:
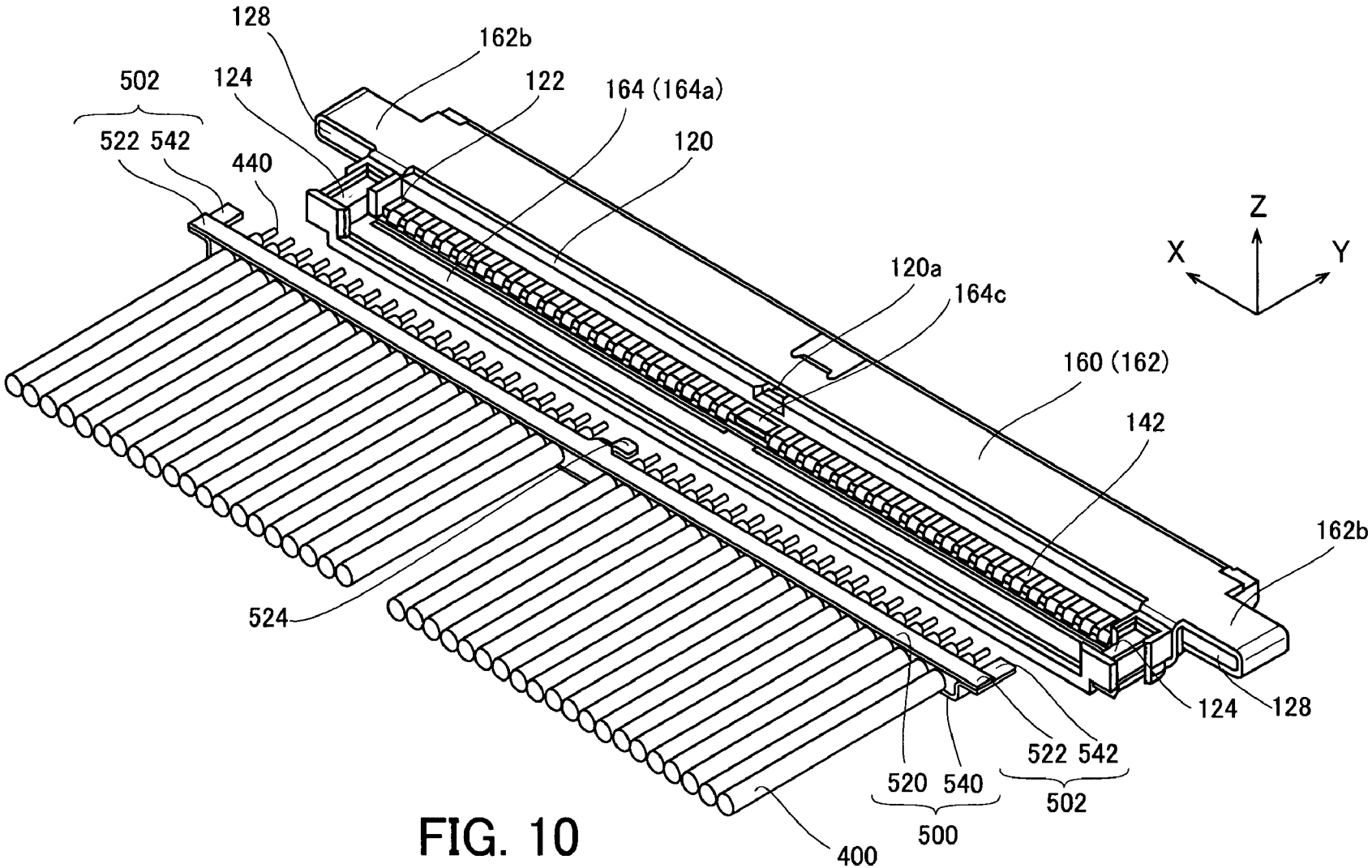
FIG. 10 is a perspective view of the structure of FIG. 9 and a plurality of cables to be connected to the structure.

With reference to FIGS. 5, 6, and 10, the cables 400 of this embodiment are small gauge coaxial cables. Each cable 400 has a shield portion 420 and a signal conductor 440. In this embodiment, the cables 400 held by the ground bar 500 are connected to the connector 100.

Figure 4:
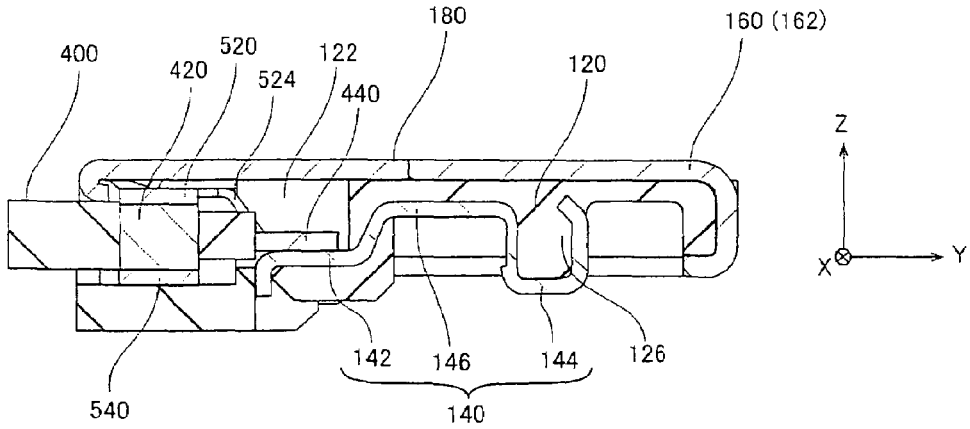
FIG. 4 is a cross-sectional view showing the connector taken along lines IV-IV in FIG. 1.

As best shown in FIG. 10, the ground bar 500 comprises an upper bar 520 and a lower bar 540. Each of the upper bar 520 and the lower bar 540 has a plate-like shape and extends in the X-direction. The upper bar 520 has two end portions 522 opposite in the X-direction and a tongue 524 extending oblique to a Y- and a Z-direction downwardly from a center of the upper bar 520. The lower bar 540 has two end portion 542*s* opposite in the X-direction. With reference to FIGS. 4, 6, and 10, the shield portions 420 of the cables 400 are held between the upper bar 520 and the lower bar 540 in the Z-direction. Then, the gap between the upper bar 520 and the lower bar 540 is filled with solder. As shown in FIG. 10, each pair of the end portion 522 and the end portion 542 constitutes a fixed portion 502 which fixes the ground bar 500 to the connector 100.

With reference to FIGS. 3 to 6, the connector 100 of this embodiment comprises an insulator 120, a plurality of contacts 140, a mold-in shell 160, and a cover shell 180. The contacts 140 are held by the insulator 120.

With reference to FIGS. 4 to 6, 9, and 10, the insulator 120 has a cable end accommodation portion 122, fix regions 124, a protrusion 126, and flat projections 128. Each cable end accommodation portion 122 accommodates ends of the cables 400. On each fix region 124, the fixed portion 502 is fixed. The protrusion 126 extends in the X-direction and protrudes in the Z-direction. Each flat projection 128 projects outwardly in the X-direction.

Figure 8:
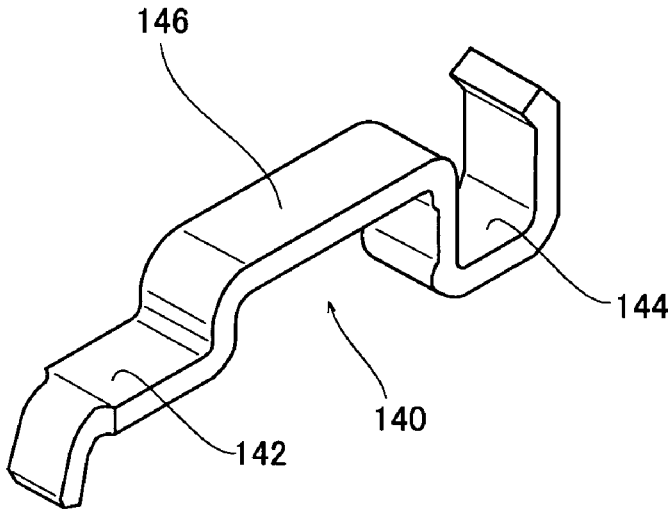
FIG. 8 is a perspective view of a contact included in the connector of FIG. 3.

With reference to FIGS. 5, 6, and 8, each of the plurality of contacts 140 has a cable connect portion 142, a mating contact connect portion 144, and a coupling portion 146. Each cable connect portion 142 is to be connected to the signal conductor 440 of each cable 400. Each mating contact connect portion 144 is to be connected to one of the contacts 240 of the mating connector 200. Each coupling portion 146 couples the mating contact connect portion 144 and the cable connect portion 142.

Figure 9:
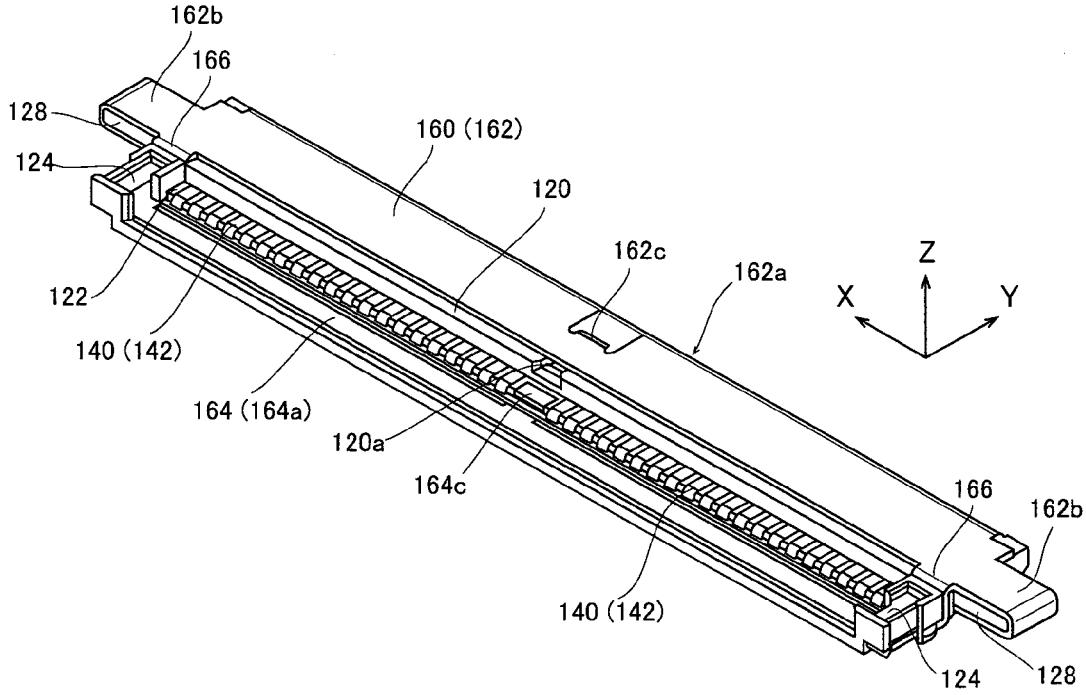
FIG. 9 is a perspective view of a structure comprising the mold-in shell of FIG. 7 and the contacts of FIG. 8 and an insulator.

With reference to FIGS. 4 and 9, the contacts 140 are formed integrally with the insulator 120 through a mold-in process so that the contacts 140 are held by the insulator 120. In addition, the cable connect portion 142 is exposed in the cable end accommodation portion 122, and the mating contact connect portion 144 is supported by the protrusion 126.

Figure 7:
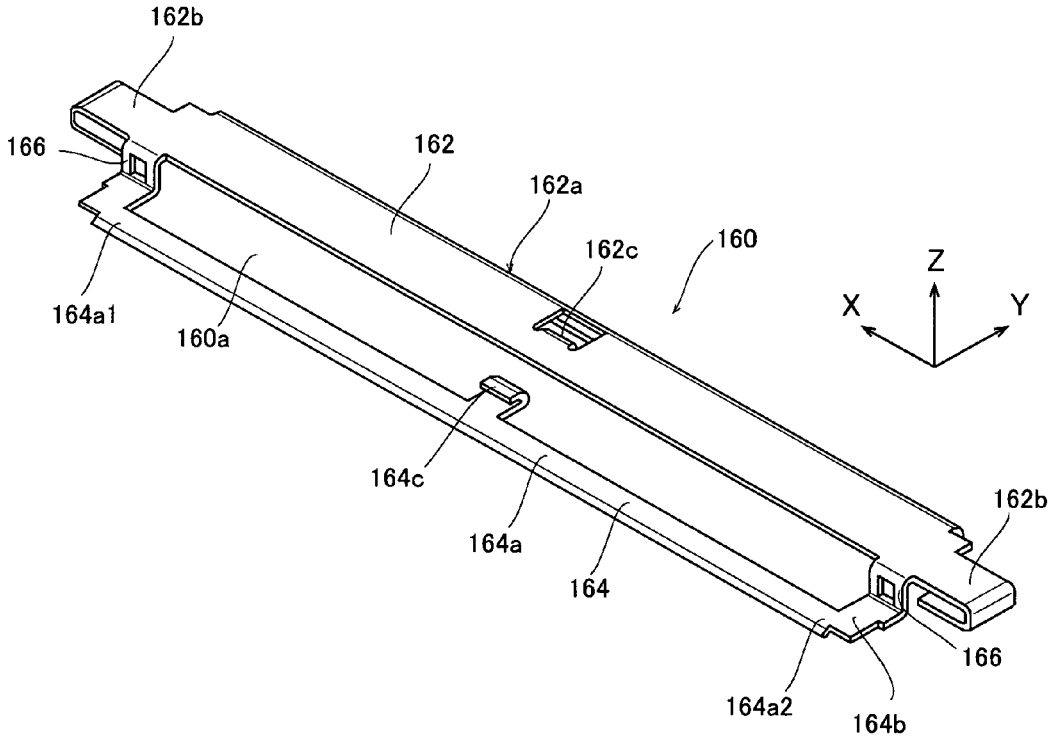
FIG. 7 is a perspective view of a mold-in shell included in the connector of FIG. 3.

With reference to FIG. 7, the mold-in shell 160 has a first body 162, a second body 164, and two coupling portions 166. The first body 162 extends in the X-direction. In other words, the first body 162 has a long side extending in the X-direction and a short side extending in the Y-direction. Likewise, the second body 164 extends in the X-direction. In other words, the second body 164 has a long side extending in the X-direction and a short side extending in the Y-direction. The coupling portions 166 couples the first body 162 and the second body 164.

The first body 162 has a front end portion 162*a*, two cover portions 162*b*, and a connect portion 162*c*. Each cover portion 162*b* protrudes outwardly in the X-direction. The connect portion 162*c* is positioned at the center of the first body 162 and extends downwardly in the Z-direction, as shown in FIG. 6.

With reference to FIG. 7, the second body 164 has a main portion 164*a* and two sub-portions 164*b*. The main portion 164*a* has a plate-like shape and extends in the X-direction. The main portion 164*a* has two ends 164*a*1 and 164*a*2 in the X-direction. The sub-portions 164*b* extend from the ends 164*a*1 and 164*a*2 in the Y-direction, respectively.

The second body 164 further has a ground connect portion 164*c* which is formed at the center of the main portion 164*a* in the X-direction and which projects in the Y-direction.

The coupling portions 166 extend in the Z-direction and connect the respective sub-portions 164*a*1 and 164*a*2 of the second body 164 to the first body 162 so that the first body 162 and the second body 164 are not positioned on a single plane. In other words, according to this embodiment, the first body 162 and the second body 164 differ in position in the Z-direction. With this structure, the mold-in shell 160 forms a path for connecting the shield portion 420 of the cable 400 with the mating shell 260 or the ground contact 240*b*.

As shown in FIG. 7, the mold-in shell 160 of this embodiment has an area 160*a* when seen along the Z-direction. The area 160*a* is defined by the first body 162 and the second body 164 connected by the coupling portions 166.

With reference to FIG. 9, the mold-in shell 160 is formed through the mold-in process according to which the mold-in shell 160 is positioned in part within the insulator 120. In this embodiment, the contacts 140 and the mold-in shell 160 are formed through the mold-in process, according to which the contacts 140 and the mold-in shell 160 are held by the insulator 120.

With reference to FIG. 9, the length of the first body 162 in the Y direction is about a half of that of the insulator 120 so that the first body 162 will not overlap with the cable connect portion 142 in the Z-direction.

With reference to FIGS. 4 to 6, the front end portion 162*a* covers a front end of the insulator 120.

Figure 3:
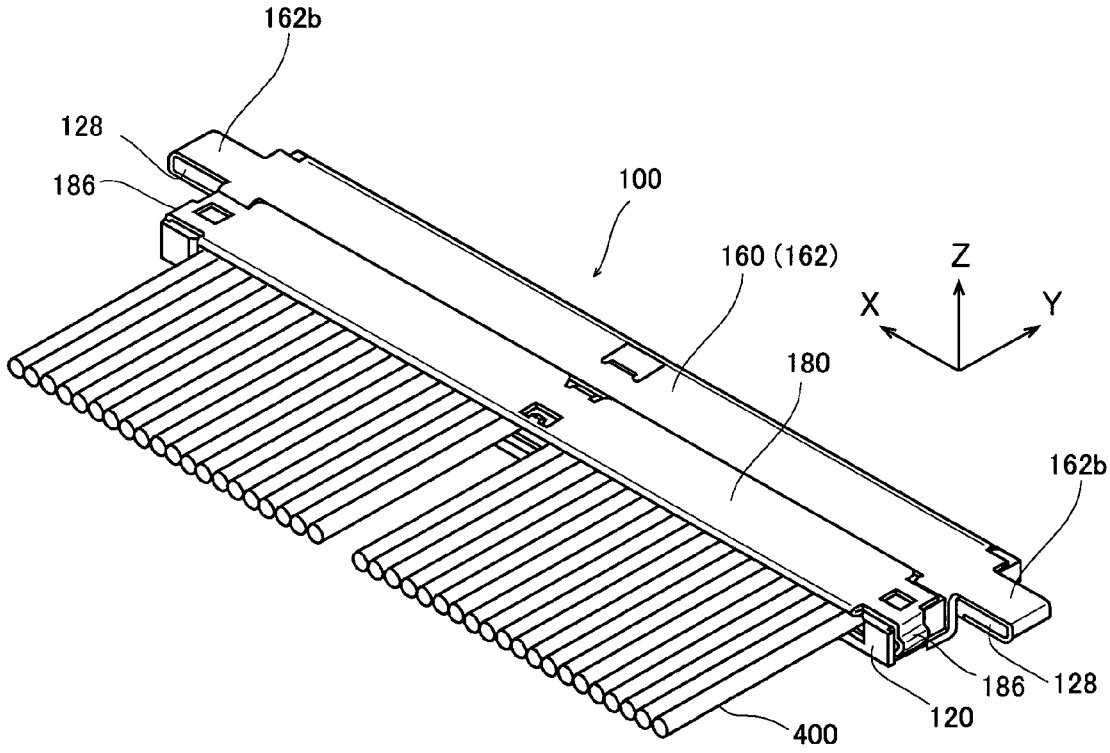
FIG. 3 is a perspective view of a connector constituting the connector assembly of FIG. 1.

With reference to FIGS. 3 and 9, each cover portion 162*b* covers the flat projection 128 of the insulator 120. As understood from FIGS. 1 to 3, each flat projection 128 is to be engaged with the receiver portion 262 of the mating connector 200.

With reference to FIG. 6, the connect portion 162*c* is positioned on a side surface of the protrusion 126 of the insulator 120. Therefore, the connect portion 162*c* becomes connectable with the ground contact 240*b* of the mating connector 200 when the connector 100 and the mating connector 200 are fitted with each other.

With reference to FIG. 6, the ground connect portion 164*c* is soldered to the tongue 524 of the ground bar 500 in the state where the main portion 164*a* is attached to the ground bar 500. With reference to FIGS. 9 and 10, the ground connect portion 164*c* is exposed inside the cable end accommodation portion 122. In addition, as is apparent from FIG. 9, the main portion 164*a* is exposed inside the cable end accommodation portion 122 but can not be seen from below the connector assembly 300 in the Z-direction. This structure enables the effective use of the surface of a board in a way by, for example, forming the wiring patterns on the board at the position under the main portion 164*a*.

With reference to FIGS. 7 and 9, the cable connect portions 142 are positioned within the area 160*a* when seen along the Z-direction. The mold-in shell 160 covers the insulator 120 and the contacts 140 except for portions to which the ends of the cables 400 are to be attached.

Figure 11:
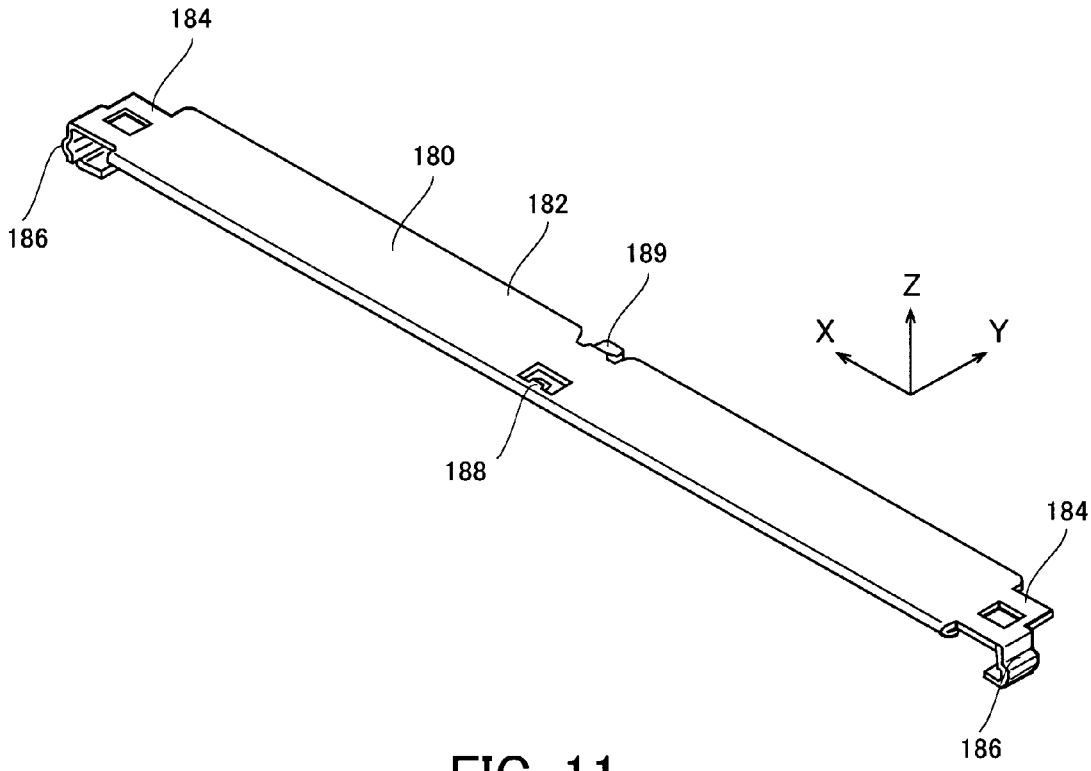
FIG. 11 is a perspective view of a cover shell included in the connector of FIG. 3.

With reference to FIG. 11, the cover shell 180 has a main portion 182, two end portions 184, two connection portions 186, a connection portion 188, and another connection portion 189. Each pair of the end portion 184 and the connection portion 186 is formed at an end of the main portion 182 in the X-direction.

As apparent from FIGS. 3 and 10, before the cover shell 180 is attached to the insulator 120, the ends of the cables 400 with the ground bar 500 are accommodated in the cable end accommodation portion 122. In detail, the signal conductors 440 of the cables 400 are connected to the cable contact portions 142 of the contacts 140, respectively, the fixed portions 502 are fixed on the fix regions 124 of the insulator 120, and the lower bar 540 of the ground bar 500 is attached to the main portion 164*a* of the second body 164.

As understood from FIGS. 3, 5, 6, 10 and 11, the cover shell 180 attached to the insulator 120 covers the ends of the cables 400 including the connection points between the signal conductors 440 of the cables 400 and the cable connect portions 142 of the contacts 140. Each end portion 184 covers the fixed portion 502. The connection portions 186 slightly protrude from the ends of the insulator 120 in the X-direction.

With reference to FIG. 6, the connect portions 188 and 189 of this embodiment are connected to the ground bar 500 and the mold-in shell 160, respectively. This structure allows the increase of the number of paths for connecting the shield portions 420 of the cables 400 to the shell 260 or the ground contact 240*b*.

As described above, the cover shell 180 of this embodiment has a simple structure. Therefore, it is advantageous that the insulator 120 will not be subjected to the excessive and undesirable power when the cover shell 180 is attached to the insulator 120. Moreover, although the mold-in shell 160 has a complex structure as compared with the cover shell 180, the mold-in shell 160 is integrated with the insulator 120 through the mold-in process when the insulator 120 is formed. Therefore, the connector 100 may have a thin shape while achieving the sufficient strength of the insulator 120.

The present application is based on a Japanese patent application of JP2007-195025 filed before the Japan Patent Office on Jul. 26, 2007, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector connectable to a plurality of cables comprising:

a plurality of contacts each having a cable connect portion to be connected to one of the cables;

an insulator holding the plurality of contacts; and a mold-in shell formed through a mold-in process according to which the mold-in shell is positioned in part within the insulator when the insulator is molded;

wherein the mold-in shell has a first body, a second body and two coupling portions, each of the first and the second bodies having a long side and a short side, the long side extending in the first direction, the short side extending in a second direction perpendicular to the first direction, the coupling portions coupling the first body with the second body so that the first body and the second body differ in position in a third direction perpendicular to the first and the second directions.

2. An electronic apparatus comprising the connector according to claim 1 and a mating connector to be connected to the connector.

3. The connector according to claim 1, wherein the second body has a first portion and two second portions, the first portion having ends in the first direction, the second portions connecting the ends of the first portion with the coupling portions, respectively.

4. The connector according to claim 3, wherein the second portions extend from the ends of the first portion to the coupling portions along the second direction, respectively.

5. The connector according to claim 1, wherein the first body and second body define a predetermined area as seen from above in the third direction, each of the cable connect portions being positioned in the predetermined area.

6. The connector according to claim 1, wherein the first body is formed so that the first body does not overlap with the cable connect portions in the third direction.

7. The connector according to claim 1, further comprising a cover-shell which covers the cable connect portions connected to the cables.

8. The connector according to claim 1, wherein, according to the mold-in process, the plurality of contacts is held by the insulator when the insulator is molded.

9. The connector according to claim 1, further comprising a ground bar, each of the plurality of cables having a shield portion, each of the shield portions being fixed on the ground bar when the cables are connected to the cable connect portions, wherein the second body has a main portion, the ground bar is mounted on to main portion of the second body.

10. The connector according to claim 9, wherein:

the ground bar has a tongue; and the second body further has a ground connect portion extending from the main portion in the second direction, the ground connect portion being connected to the tongue when the ground bar is positioned on the main portion.

11. The grand bar according to claim 10, wherein the ground bar comprises an upper bar and a lower bar, the shield portions of the cables being held between the upper bar and the lower bar, the tongue extending downward from the upper bar, the lower bar being mounted on the main portion.

* * * * *